United States Patent [19]

Richeson

[11] Patent Number: 5,022,358

[45] Date of Patent: Jun. 11, 1991

[54] LOW ENERGY HYDRAULIC ACTUATOR

[75] Inventor: William E. Richeson, Fort Wayne, Ind.

[73] Assignee: North American Philips Corporation, New York, N.Y.

[21] Appl. No.: 557,377

[22] Filed: Jul. 24, 1990

[51] Int. Cl.[5] ..... F15B 13/044; F01L 9/02

[52] U.S. Cl. ..... 123/90.12; 123/90.11; 123/90.14; 91/459; 91/42; 137/625.65; 137/906; 251/63.5

[58] Field of Search ..... 123/90.11, 90.12, 90.14; 91/42, 459; 92/82, 92; 137/625.6, 625.64, 906; 251/63.5

[56] References Cited

U.S. PATENT DOCUMENTS

| | | | |
|---|---|---|---|
| 4,187,764 | 2/1980 | Cho | 137/596.16 |
| 4,543,874 | 10/1985 | Henriksson | 91/459 |
| 4,724,801 | 2/1988 | O'Neill | 123/90.12 |
| 4,791,895 | 12/1988 | Tittizer | 123/90.11 |
| 4,794,890 | 1/1989 | Richeson, Jr. | 123/90.11 |
| 4,831,973 | 5/1989 | Richeson, Jr. | 123/90.11 |
| 4,872,425 | 10/1989 | Richeson et al. | 123/90.14 |
| 4,974,495 | 12/1990 | Richeson, Jr. | 91/459 |

FOREIGN PATENT DOCUMENTS

| | | | |
|---|---|---|---|
| 2151331 | 4/1973 | Fed. Rep. of Germany | 123/90.11 |
| 3806969 | 4/1989 | Fed. Rep. of Germany | 123/90.12 |

*Primary Examiner*—Willis R. Wolfe
*Assistant Examiner*—Tom Moulis
*Attorney, Agent, or Firm*—Robert J. Kraus

[57] ABSTRACT

An electronically controllable hydraulically powered asymmetrical valve actuating mechanism for use in an internal combustion engine of the type having engine intake and exhaust valves with elongated valve stems is disclosed. The actuator is a bistable electronically controlled hydraulically powered transducer having an armature including a power piston which is reciprocable between first and second positions along with a hydraulic arrangement for powering the armature from a first (engine valve closed) position to a second position. A bistable control valve is operable in one of its stable states to supply high pressure hydraulic fluid to one face of the piston to power the armature and in the other of its stable states to relieve the high pressure fluid from the piston. The mechanism has a compressible resilient arrangement such as a coil spring or a chamber in which air is compressed during motion of the armature from the first position to the second position. This compression of the air not only slows armature motion as it nears the second position, but also provides a potential energy store for powering the armature back to its initial position. The control valve remains in said one stable state to temporarily prevent reversal of armature motion when the motion of the armature has slowed to a stop, the control valve returning to the other of its stable states on command to allow the spring or air compressed in the chamber to return the armature to the first position.

20 Claims, 2 Drawing Sheets

LOW ENERGY HYDRAULIC ACTUATOR

SUMMARY OF THE INVENTION

The present invention relates generally to a two position, bistable, asymmetrical, straight line motion actuator and more particularly to a fast acting actuator which utilizes hydraulic fluid pressure against a piston to perform fast transit from a first position to a second position and converts and stores the piston's kinetic energy to be subsequently used to transit from the second position back to the first.

This actuator finds particular utility in opening and closing the gas exchange, i.e., intake or exhaust, valves of an otherwise conventional internal combustion engine. Due to its fast acting trait, the valves may be moved by the fluid pressure from the full closed to the full open position, and from the full open back to the full closed by the stored piston energy almost immediately rather than gradually as is characteristic of cam actuated valves. The actuator mechanism may find numerous other applications.

Hydraulic fluid powered valve actuators have been suggested in the literature, but have not met with much commercial success because, among other things, it is difficult and time consuming to move a large quantity of hydraulic fluid through a pipe or conduit of a significant length (more precisely, long in comparison to its cross-section). Hence, systems with lengthy connections are also plagued by lengthy response times.

For example, U.S. Pat. No. 4,791,895 discloses an engine valve actuating mechanism where an electromagnetic arrangement drives a first reciprocable piston and the motion of that piston is transmitted through a pair of pipes to a second piston which directly drives the valve stem. This system employs the hydraulic analog of a simple first class lever to transmit electromagnet generated motion to the engine valve. U.S. Pat. No. 3,209,737 discloses a similar system. but actuated by a rotating cam rather than the electromagnet.

U.S. Pat. No. 3,548,793 employs electromagnetic actuation of a conventional spool valve in controlling hydraulic fluid to extend or retract push rods in a rocker type valve actuating system.

U.S. Pat. No. 4,000,756 discloses another electro-hydraulic system for engine valve actuation where relatively small hydraulic poppet type control valves are held closed against fluid pressure by electromagnets and the electromagnets selectively deenergized to permit the flow of fluid to and the operation of the main engine valve.

In copending application Ser. No. 07/457,015 entitled ELECTRO-HYDRAULIC VALVE ACTUATOR, now U.S. Pat. No. 4,974,495, there is a fast acting valve actuator for actuating an intake or exhaust valve in an internal combustion engine of a type which is hydraulically powered and command triggered. This actuator includes a cylinder with a power piston having a pair of opposed working surfaces or faces which is reciprocable within the cylinder along an axis between first and second extreme positions. A cylindrical control valve is Located radially intermediate the reservoir and the cylinder, and is movable upon command to alternately supply high pressure fluid from a reservoir of high pressure hydraulic fluid to one face and then the other face of the power piston causing the piston to move from one extreme position to the other extreme position. The cylindrical control valve may be a shuttle valve which is reciprocable along the axis of the power piston between extreme positions with control valve motion along the axis in one direction being effective to supply high pressure fluid to move the piston in the opposite direction. Both the control valve and the piston are stable in both of their respective extreme positions and the control valve is spring biased toward a position intermediate the extreme positions. The latter portion of piston motion during one operation of the valve actuator is effective to cock this spring and bias the control valve preparatory to the next operation.

U.S. Pat. Nos. 4,883,025 and 4,831,973 disclose symmetric bistable compressed air powered actuators which attempt to recapture some of the piston kinetic energy as either stored compressed air or as a stressed mechanical spring which stored energy is subsequently used to power the piston on its return trip. In either of these patented devices, the energy storage device is symmetric and is releasing its energy to power the piston during the first half of each translation of the piston and is consuming piston kinetic energy during the second half of the same translation regardless of the direction of piston motion.

Our recent invention entitled ACTUATOR WITH ENERGY RECOVERY RETURN, Ser. No. 07/557,370, filed on July 24, 1990, still pending, discloses an arrangement which propels an actuator piston from a valve-closed toward a valve-open position and utilizes the air which is compressed during the damping process to power the actuator back to its initial or valve-closed position. Moreover, an actuator capture or latching arrangement, such as a hydraulic latch, is used in this recent invention to assure that the actuator does not immediately rebound, but rather remains in the valve-open position until commanded to return to its initial position The initial translation of the actuator piston in this recent application is powered by pneumatic energy for an air pump and requires relatively large source pump as well as relatively large individual valve actuators.

Our recent invention entitled HYDRAULICALLY PROPELLED PNEUMATICALLY RETURNED VALVE ACTUATOR, Ser. No. 07/557,369, filed on July 24, 1990, still pending, discloses an actuator which is used to operate an internal combustion engine poppet valve which is configured to open the poppet valve by means of a high pressure hydraulic fluid. This fluid powers the actuator piston and, at the same time, compresses air to accomplish both damping of the piston and conversion of the kinetic energy of piston translation into potential (pneumatic) energy. The actuator is held or captured in the second or valve-open position by a hydraulic latch and when released, is returned by the stored pneumatic energy to its initial position. The hydraulic latch may share much of the same mechanism with that which propels the valve to its valve-open position. Damping of the returning actuator piston is accomplished by a separate adjustable pneumatic orifice arrangement to assure gentle seating of the poppet valve.

The entire disclosures of all of the above identified copending applications and patents are specifically incorporated herein by reference.

The present invention takes advantage of many of the developments disclosed in the lastmentioned ACTUATOR WITH ENERGY RECOVERY RETURN and HYDRAULICALLY PROPELLED PNEUMATI- CALLY RETURNED VALVE ACTUATOR applications. The initial power translation is accomplished by hydraulic energy from a hydraulic pump by way of a spring-loaded high pressure fluid accumulator in very close proximity to the piston being powered by the fluid. Hydraulic energy propulsion yields the advantages of reduced actuator size and, therefor, is easier to package, as well as a reduction of the size of and, therefor, the space required underneath a vehicle hood by the hydraulic pump.

In the present application, a piston is powered from a first (engine valve closed) position by high pressure hydraulic fluid in a manner similar to the abovementioned ELECTRO-HYDRAULIC VALVE ACTUATOR. As in that application, a relatively constant high pressure source is maintained close to the piston and the fluid ducting and valving path therebetween has a very high ratio of cross-section to length. This makes the valve very fast acting to open an engine valve and significantly reduces losses as compared to conventional hydraulic systems. As the piston approaches the engine valve-open position, the piston assembly including the engine valve are slowed or damped and piston assembly kinetic energy is converted to and stored as potential energy. This potential energy is subsequently utilized to drive the piston back to its initial or valve-closed position.

Among the several objects of the present invention may be noted the provision of a hydraulically powered engine valve actuator which uses about one-half the volume of hydraulic fluid for each valve cycle as compared to the closest known prior art; the provision of a hydraulically powered engine valve actuator which is hydraulically driven in only one direction with return drive being supplied by energy recovered from the motion in the one direction; the provision of a hydraulically powered engine valve actuator in accordance with the previous object which is capable of more rapid operation because its hydraulic supply recovery time is spread out over a complete cycle rather than each one-half cycle as heretofor; the provision of an asymmetrical actuator which is hydraulically propelled in one direction in accordance with known techniques, but then the actuator is locked or latched against the force of retained compressed air, a coil spring or similar resilient arrangement for a controlled length of time; the provision of an actuator in accordance with the previous object which is latched by the hydraulic pressure which propelled it in the one direction, that pressure being relieved at the prescribed time thereby releasing the actuator to move in the opposite direction back to its initial position under the force of the resilient arrangement; the provision of an actuator in accordance with either of the previous objects wherein latching and unlatching are under the control of a bistable control valve which is driven to one stable state to supply hydraulic fluid to propel the actuator and subsequently returned to the other stable state allowing the resiliently powered return of the actuator; the provision of an actuator in accordance with the previous object which adequately and reliably holds a piston assembly against the strong force of the resilient arrangement while releasing quickly to allow a very fast return of the actuator piston assembly to its initial position; and the provision of proper engine valve seating pressure by the application of a controlled latching force to the valve piston. These as well as other objects and advantageous features of the present invention will be in part apparent and in part pointed out hereinafter.

In general, an asymmetrical bistable hydraulically powered actuator mechanism reciprocable between each of two stable positions and includes a replenishable source of high pressure hydraulic fluid and a power piston with a pair of opposed faces positioned closely adjacent to the source of high pressure fluid. A control valve selectively supplies high pressure fluid to one of the power piston faces thereby causing translation of a portion of the mechanism which includes the power piston in one direction. There is a resilient means such as a coil spring or air compression chamber Which is compressed during translation of the mechanism portion in said one direction slowing the mechanism portion translation in that one direction. Reversal of translation direction is temporarily prevented by maintaining the high fluid pressure on the face of the piston When the motion of that portion slows to a stop. The mechanism portion is held in one of its stable positions by the high pressure hydraulic fluid and held in the other of its stable positions by the resilient means and release of the high fluid pressure from said one power piston face frees the portion of the mechanism to move under the urging of the resilient means in a direction opposite said one direction. The piston also provides a hydraulic damping arrangement for slowing motion of the mechanism portion as it nears either of its stable positions.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The actuator and its operation in one direction is similar to the actuator disclosed in the copending application Ser. No. 07/457,015 filed Dec. 26, 1989 and entitled ELECTRO-HYDRAULIC VALVE ACTUATOR, now U.S. Pat. No. 4,974,495. The actuator of the present invention differs from that disclosed in the last-mentioned prior application in that a hydraulic source provides thrust in one direction only. An energy recovers scheme is included to appropriately slow the actuator piston and capture the kinetic energy of the actuator piston to power that piston on its return trip. Under such circumstances, only half the hydraulic fluid flow is required from the source. This in turn allow nearly double the repetition rate for opening and closing because high pressure fluid accumulators near the piston need to be replenished only once per cycle rather than twice per cycle as in the prior device.

Figure 1:
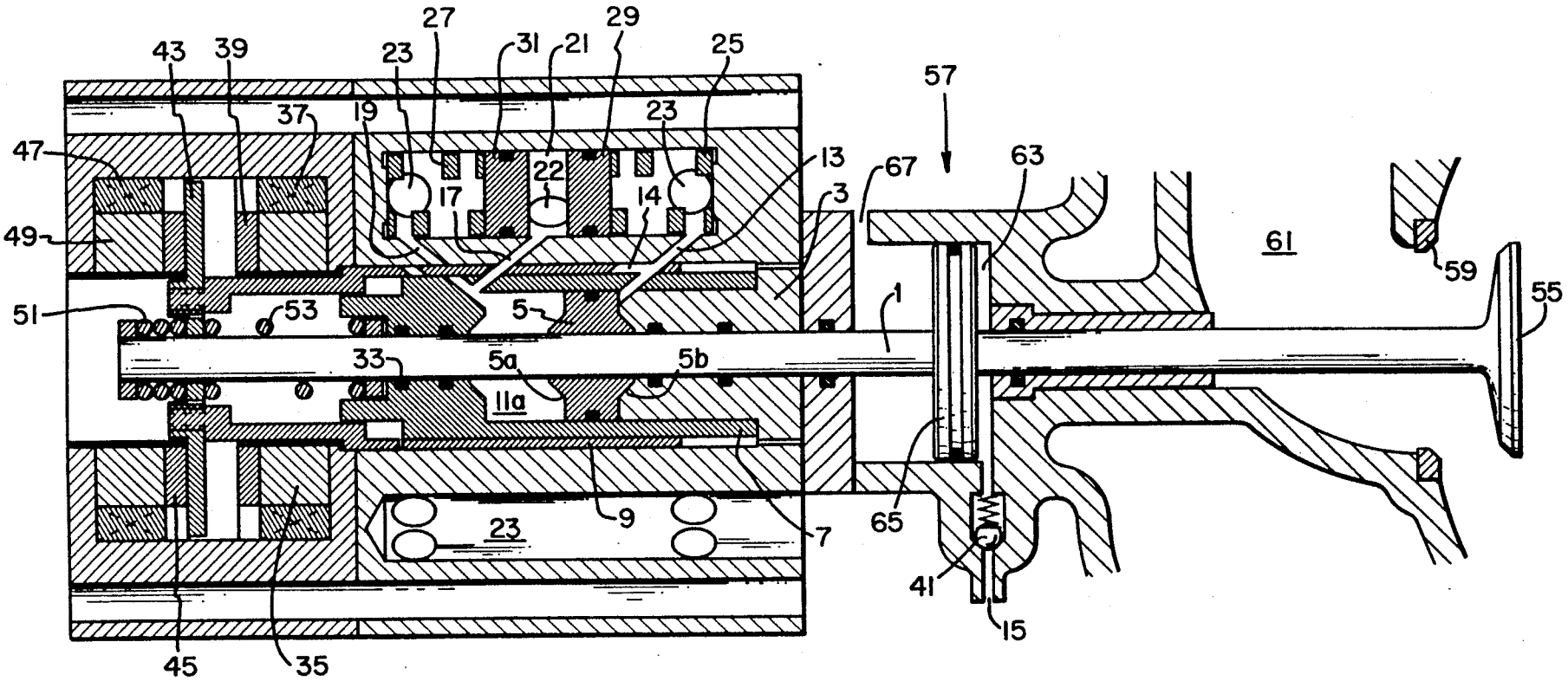
FIG. 1 is a view in cross-section of a hydraulic valve actuator coupled to an illustrative internal combustion engine valve and illustrating the present invention in one form.

The drawings depict an electrically controlled actuator that is powered hydraulically in one direction only to open an engine combustion chamber valve. During the opening of the valve, kinetic energy of the valve and the components coupled thereto (collectively the valve assembly) is recovered and stored as potential energy in either a coil spring (FIG. 2) or, in the preferred embodiment, in an air spring (variable volume air compression chamber) as shown in FIG. 1. The actuator operation is such that the valve assembly is latched in the valve-open position by maintaining the opening hydraulic pressure. The internal valving of the actuator is such that this holding force can be quickly relieved to allow the air or mechanical spring to force the engine valve back to its closed position. Both the opening and the closing of the engine valve is hydraulically damped. Piston 5 moves very fast but the piston is shaped so that the fluid is compressed in the final thousandths of an inch allowing the valve to be properly damped. The shape of main piston 5 helps to dampen the actuator motion when the piston starts to come to rest. The dampening is due to the shear forces in the captured fluid on the right side of piston 5. These shear forces are caused by the high fluid pressures existing during this period which causes the fluid to exit at high velocities. The hydraulic circuit contributes to very rapid opening and closing of the engine valve by us of high volume accumulators which supply the required high pressure fluid volume as well as providing immediate sinking of the low pressure fluid volume. During and after engine valve opening, the special accumulator is re-cocked, i.e , its hydraulic fluid supply is refilled against the spring-loaded pistons 29 and 31. When a signal is given for the actuator to allow closure of the engine valve, the immediate circuit for the hydraulic fluid does not require an external fluid circuit and the closure is rapid. This porting of the fluid removes the high pressure from the left side 5*a* of piston 5 and couples the fluid in chamber 11*a* to the right face 5*b* of the piston 5 as well as to the low pressure side of the system. This raceway fluid path allows the fluid to be exchanged rapidly from one side of the piston to the other side.

The prior re-cocking of the accumulator takes place during the time that the valve is open as well as during and after the engine valve is closed thereby allowing a more rapid repetition rate than in the abovementioned ELECTRO-HYDRAULIC VALVE ACTUATOR where the accumulator fluid supply is tapped twice in each complete cycle of the mechanism.

In the preferred form where the air return spring is used, the air pressure in the air spring return cylinder is established by the air source pressure at inlet 15 and the ball check valve 41.

FIG. 1 shows the first quadrant of the hydraulic valve actuator similar to FIG. 1 of the abovementioned ELECTRO-HYDRAULIC VALVE ACTUATOR coupled to an ILLUSTRATIVE engine valve and a potential energy return mechanism 57. The actuator includes a shaft 1 coupled with a piston 5 in a cylinder 11 made up by sleeve 7 surrounded by valve 9 in main body 3. Cylinder 11 communicates with high pressure cylinder 21 through port 17. Note that there is no corresponding port from the high pressure hydraulic source to the right face of piston 5. Cylinder 11 also communicates with low pressure "return" cylinder 23 through ports 13 and 19. High pressure cylinder 21 is made up by main body 3 and has pistons 29 and 31 which are coupled to springs 25 and 27 respectively. Seals 33 are used to insure no leakage of fluid.

The hydraulic valve actuator is an electronically controlled hydraulically powered valve actuator or transducer and includes a constant pressure source of high pressure fluid built around the pistons 29 and 31 and compression springs 27 and 25. The constant pressure source comprises a cylinder with the pair of spaced apart pistons 29 and 31 spring biased toward one another. A high pressure galley 22 is fed from a remote high pressure source (not shown) and is coupled to the space intermediate the pistons and an arrangement including the bistable hydraulic fluid control valve 9 intermittently delivers high pressure fluid from the space intermediate the pistons as the pistons collapse toward one another due to the spring bias while maintaining the fluid pressure in chamber 21 as fluid exits the space. As the pistons collapse toward each other, their opposite sides create increasing volumes which act as sinks for the volume of low pressure exhaust from the actuator via conduits 13 or 19.

Generally speaking, the hydraulically actuated transducer has a transducer housing or main body 3 and a member or working piston 5 reciprocable within the housing along an axis. The piston has a pair of opposed primary working surfaces which define chambers 11*a* (to the left of the piston 5 when in the position shown) and 11*b* (to the right of the piston when it has moved leftward to the engine valve closed position). Chamber 11*a* receives hydraulic fluid pressure for moving the piston along the axis toward the right. A high pressure hydraulic fluid source 21 selectively supplies fluid to the piston's left face under the control of a bistable hydraulic fluid control valve 9. Valve 9 is a shuttle valve reciprocable along the same axis as the piston and reciprocates relative to both the housing and the reciprocable member between first and second stable positions. An electronic control arrangement selectively actuates the control valve to move from one stable position to the other stable position to enable the flow of high pressure hydraulic fluid to one of the primary working surfaces.

The hydraulic valve actuator uses electronic controlled magnetic latches. The latches consist of permanent magnets 35 and 49, coils 37 and 47, pole pieces 39 and 45; and armature 43. The latches are used to control the valve actuator by translating armature 43 which is coupled to valve 9. Armature 43 and valve 9 are propelled by springs 51 and 53. When armature 43 and valve 9 are allowed to move. cylinder 11*a* is opened to high pressure cylinder 21 through port 17 and the opposite side, cylinder 11*a* is opened to low pressure cylinder 23 through port 13.

In FIG. 1 the piston 5 is shown in the closed right position (which corresponds to the engine valve being open) with the armature 43 and valve 9 closed (latched to permanent magnet 49). In this configuration, high hydraulic fluid pressure is maintained in chamber 11*a* and the piston 5 is held in the rightmost position as shown. Energization of coil 47 will neutralize the holding effect of magnet 49 allowing spring 51 and the attractive force of magnet 35 to capture the armature 43 in its rightmost position. This closes conduit 17 and opens conduit 19 allowing the high pressure fluid to escape from cylinder chamber 11*a*. Note that the slot 14 in reciprocating valve member 9 is sufficiently long that the conduit 13 from chamber 11*b* on the right side of piston 5 to the low pressure return cylinder 23 remains open regardless of the position of valve member 9. The potential energy return mechanism 57 is now free to force the piston leftward to the valve-closed position. As the piston moves toward the left, the fluid on the left side of piston 5 is allowed to be exchanged to the right side of piston 5 by way of a very short low resistance path including passageway 19, cylinder 23 and passageway 13.

In the valve-closed position, the valve 55 is held firmly against valve seat 59 closing an engine intake or exhaust port 61 by air pressure in the cylinder space 63 to the right face of piston 65. This latching air pressure is supplied by way of a one-way check valve 41 connected to an air pump or other source of above atmospheric air pressure at inlet 15. The left face of piston 65 is always exposed to atmospheric pressure via vent 67.

The operation of the mechanism of FIG. 1 should now be clear. Valve 55 is held closed on seat 59 by the residual air pressure in chamber 63. This pressure is maintained at a latching pressure (above atmospheric) by make up air supplied through inlet 15 and check valve 41. The air makes up for frictional and other losses. When coil 37 is energized, the bistable control valve 9 moves to the position shown in FIG. 1 admitting high pressure air from accumulator to the right face of piston 5 driving the valve open. So long as the control valve remains in the position shown, the high pressure in chamber 11*a* holds the valve open and prevents the air compressed in chamber 63 from causing mechanism reversal. When coil 47 is energized, the control valve returns against magnet 35 closing the high pressure conduit 17 and venting fluid to chamber 23. Piston 65 is forced by the air pressure toward the left closing the engine valve.

Figure 2:
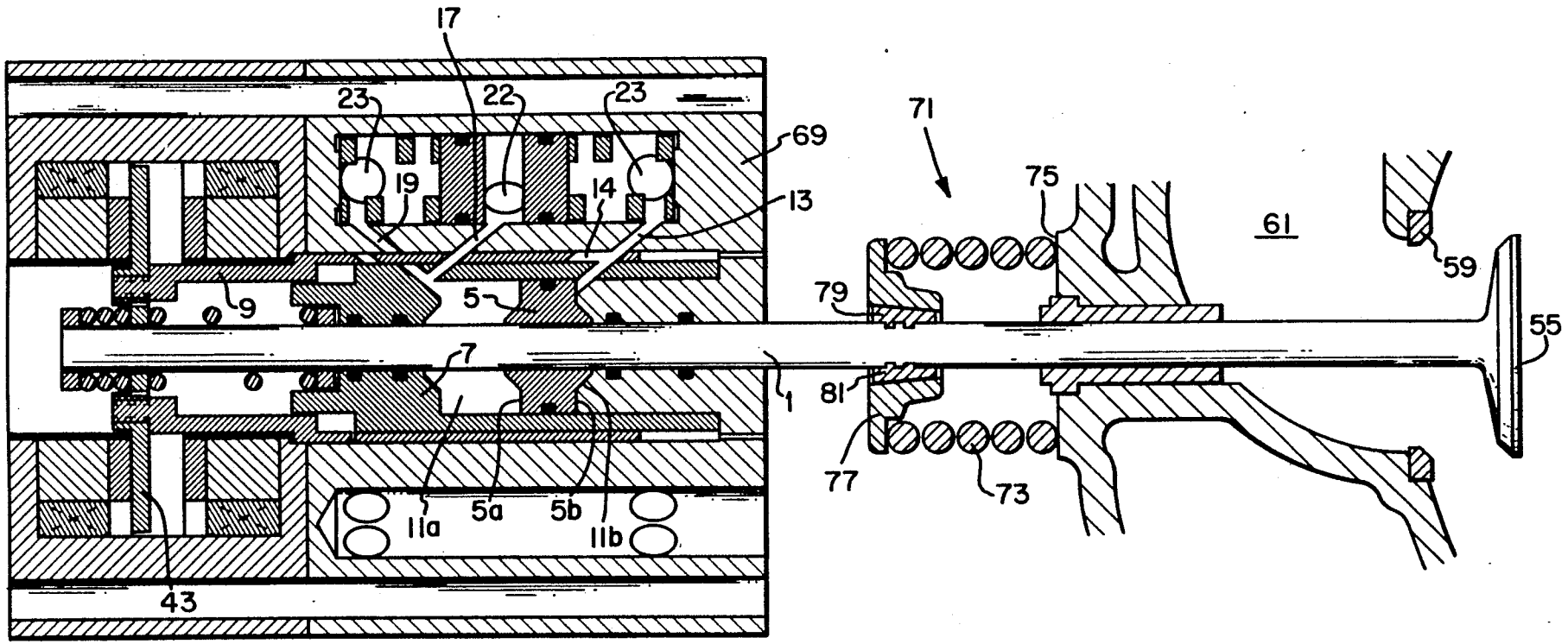
FIG. 2 is a view in cross-section similar to FIG. 1, but showing a variation on the potential energy powered return mechanism.

FIGS. 1 and 2 both depict an electronically controllable hydraulically powered asymmetrical valve actuating mechanism for use in an internal combustion engine of the type having engine intake and exhaust valves with elongated valve stems. Each has a power piston 5 having a pair of opposed faces 5*a* and 5*b* defining variable volume chambers such as 11*a*. The power piston 5 is reciprocable along an axis corresponding to the axis of the valve stem and is adapted to be coupled to an engine valve 55. A hydraulic motive means including piston 5, control valve 9 and high pressure cylinder 21 is effective to unilaterally move the piston 5 thereby causing the engine valve 55 to move in the direction of stem elongation from a valve-closed to a valve-open position. The control valve 9 is a two position control valve operable in a first position as shown in the drawings to supply high pressure hydraulic fluid to the variable volume chamber 11*a* and to relieve the hydraulic pressure in the other variable volume chamber defined by piston face 5*b*. In the second position (not shown), control valve 9 is effective to open conduit 19 to relieve the hydraulic pressure in both the variable volume chambers. Notice conduit 13 is open in either control valve position. Resilient damping means 57 or 71 imparts a continuously increasing decelerating force as the engine valve approaches the valve-open position and when the control valve releases the high pressure from face 5*a*, the resilient damping means powers the piston back to the valve-closed position. The hydraulic motive means includes a variable volume (chamber 21) spring (25 and 27) biased hydraulic fluid accumulator in close proximity to the area of the piston for continuously receiving high pressure fluid and intermittently supplying fluid to power the piston. In FIG. 1, the resilient damping means 57 comprises a damping piston 65 which is movable with the power piston 5 and defining a variable volume damping chamber 63. A predetermined quantity of air as fixed by the pressure at inlet 15 and the maximum chamber volume when valve 55 is seated is trapped within the variable volume chamber and compressed as the engine valve approaches the valve-open position. In FIG. 2, the resilient damping means 71 comprises a coil spring 73 providing a variable force coupling between the movable shaft 1 and a fixed portion of the engine.

In FIG. 2, the portion of the mechanism to the left of surface 69 operates identically to that described in connection with FIG. 1. A pair of variable volume chambers 11*a* and 11*b* have volumes which vary with armature reciprocation while the sum of the volumes of the two chambers remains substantially constant. High pressure hydraulic fluid is selectively supplied to variable volume chamber 11*a* while low pressure fluid exhausted from chamber 11*b* when high pressure fluid is being supplied to chamber 11*a* . The control valve 9 is reciprocable between first and second stable positions with movement of that control valve in one direction (toward the left as viewed) providing hydraulic fluid to volume chamber 11*a* a to power the armature causing the armature to move in a direction opposite, i.e., to the right. Movement of the control valve 9 in the opposite direction from the other stable position back to said one stable position provides a short, low resistance, fluid path from said one variable volume chamber 11*a* to the other of the variable volume chambers 11*b* by way of passageways 13 and 19, and cylinder 23.

In FIG. 2, the potential energy return mechanism 57 has been replaced with a mechanical spring potential energy return mechanism 71. Coil spring 73 is captured between engine surface 75 and the keeper 77. The keeper 77 functions much the same as conventional valve spring keepers in that a pair of tapered pieces are trapped and held in engagement with the shaft 1 by the correspondingly tapered inner surface of the keeper 77. Depression against the spring force without moving the shaft 1 frees the pieces 79 and 81. Spring 73 normally maintains the valve 55 firmly in contact with valve seat 59. When the control valve 9 is moved to the position shown in FIG. 2, the high hydraulic pressure on piston 5 forces the piston to the right, overcomes the force of and compresses the coil spring 73 and, at the same time, stores the energy in that compressed spring 73 for the return trip of the piston assembly to the valve-closed position.

From the foregoing, it is now apparent that a novel arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An asymmetrical bistable hydraulically powered actuator mechanism reciprocable between each of two stable positions and comprising:

a replenishable source of high pressure hydraulic fluid, a power piston having a pair of opposed faces and positioned closely adjacent the source of high pressure fluid, and a control valve for selectively supplying high pressure fluid to one of the power piston faces thereby causing translation of a portion of the mechanism which includes the power piston in one direction;

resilient means which is compressed during translation of the mechanism portion in said one direction, compression of the resilient means slowing the mechanism portion translation in said one direction;

means for temporarily preventing reversal of the direction of translation of the mechanism portion when the motion of that portion slows to a stop; and hydraulic damping means for slowing motion of the mechanism portion as it nears either of its stable positions.

2. The asymmetrical bistable hydraulically powered actuator mechanism of claim 1 wherein the mechanism portion is held in one of its stable positions by the high pressure hydraulic fluid and held in the other of its stable positions by the resilient means, release of the high fluid pressure from said one power piston face freeing the portion of the mechanism to move under the urging of the resilient means in a direction opposite said one direction.

3. The asymmetrical bistable hydraulically powered actuator mechanism of claim 1 wherein the resilient means includes a pneumatic piston comprising a part of and movable with the mechanism portion for compressing air in a closed chamber, the actuator mechanism further comprising means for supplying makeup air to said chamber to compensate for frictional and other losses.

4. The asymmetrical bistable hydraulically powered actuator mechanism of claim 1 wherein the control valve is reciprocable between first and second stable positions, movement of the control valve in one direction from one stable position to the other stable position providing hydraulic fluid to the power piston causing the power piston to move in a direction opposite said on direction.

5. The asymmetrical bistable hydraulically powered actuator mechanism of claim 1 wherein the replenishable source or high pressure hydraulic fluid includes a low volume constant pressure source of high pressure fluid comprising a cylinder with a pair of spaced apart pistons spring biased toward one another; a remote high pressure source coupled to the space intermediate the pistons; means including said control valve for intermittently delivering high pressure fluid from the space intermediate the pistons whereby the pistons collapse toward one another due to the spring bias while maintaining the fluid pressure as fluid exits the space.

6. The asymmetrical bistable hydraulically powered actuator mechanism of claim 5 wherein the cylinder with the pair of spaced apart pistons provides a low volume, low pressure fluid sink in the expanding space left behind as the pistons collapse toward one another during mechanism portion translation in said one direction.

7. The asymmetrical bistable hydraulically powered actuator mechanism of claim 1 further including a fluid sink for receiving low pressure fluid exhausted by the other of the power piston faces while high pressure fluid is being supplied to said one power piston face.

8. The asymmetrical bistable hydraulically powered actuator mechanism of claim 1 wherein the control valve is reciprocable between first and second stable positions, movement of the control valve in one direction from one stable position to the other stable position providing hydraulic fluid to the power piston causing the power piston to move in a direction opposite said one direction, movement of the control valve in the opposite direction from the other stable position back to said one stable position providing a short, low resistance, fluid path from said one power piston face to the other of the power piston faces.

9. The asymmetrical bistable hydraulically powered actuator mechanism of claim 1 further including an inlet valve for supplying a latching air pressure to said chamber when the mechanism portion is in one of its stable positions to latch the mechanism portion in that stable position until mechanism portion translation is initiated by the control valve.

10. An electronically controllable hydraulically powered asymmetrical valve actuating mechanism for use in an internal combustion engine of the type having engine intake and exhaust valves with elongated valve stems, the actuator comprising;

a power piston having a pair of opposed faces defining variable volume chambers, the power piston being reciprocable along an axis and adapted to be coupled to an engine valve;

hydraulic motive means for unilaterally moving the piston, thereby causing the engine valve to move in the direction of stem elongation from a valve-closed to a valve-open position, the hydraulic motive means including a two position control valve operable in a first position to supply high pressure hydraulic fluid to one of said variable volume chambers and to relieve the hydraulic pressure in the other of the variable volume chambers, and in a second position to relieve the hydraulic pressure in both the variable volume chambers; and resilient damping means for imparting a continuously increasing decelerating force as the engine valve approaches the valve-open position; and means operable on command for utilizing the resilient damping means to power the piston back to the valve-closed position.

11. The electronically controllable hydraulically powered asymmetrical valve actuating mechanism of claim 10 wherein the hydraulic motive means includes a variable volume spring biased hydraulic fluid accumulator in close proximity to the area of the piston for continuously receiving high pressure fluid and intermittently supplying fluid to power the piston.

12. The electronically controllable hydraulically powered asymmetrical valve actuating mechanism of claim 10 wherein the means utilizing the resilient damping means is operable to move the control valve from the first position to the second position thereby freeing the resilient damping means to power the piston back to the valve-closed position.

13. The electronically controllable hydraulically powered asymmetrical valve actuating mechanism of claim 12 wherein the resilient damping means comprises a damping piston movable with the power piston and defining a variable volume damping chamber, a predetermined quantity of air being trapped within the variable volume chamber and compressed as the engine valve approaches the valve-open position.

14. A bistable electronically controlled hydraulically powered transducer having an armature reciprocable between first and second positions, hydraulic means for powering the armature from the first position to the second position, said hydraulic means including a bistable control valve operable in one of its stable states to supply high pressure hydraulic fluid to power the armature and in the other of its stable states to relieve the high pressure fluid from the armature, a chamber in which air is compressed during motion of the armature from the first position to the second position, compression of the air slowing armature motion as it nears the second position, the control valve remaining in said one stable state to temporarily prevent reversal of armature motion when the motion of the armature has slowed to a stop, the control valve returning to the other of its stable states on command to allow the air compressed in the chamber to return the armature to the first position.

15. The asymmetrical bistable electronically controlled hydraulically powered transducer of claim 14 further comprising a pair of variable volume chambers the volumes of which vary with armature reciprocation while the sum of the volumes of the two chambers remains substantially constant, the hydraulic means including means for selectively supplying high pressure fluid to one of said variable volume chambers, and a fluid sink for receiving low pressure fluid exhausted from the other of the variable volume chambers when high pressure fluid is being supplied to said one variable volume chamber, the control valve being reciprocable between first and second stable positions, movement of the control valve in one direction from one stable position to the other stable position providing hydraulic fluid to said one variable volume chamber to power the armature causing the armature to move in a direction opposite said one direction, movement of the control valve in the opposite direction from the other stable position back to said one stable position providing a short, low resistance, fluid path from said one variable volume chamber to the other of the variable volume chambers.

16. The asymmetrical bistable electronically controlled hydraulically powered transducer of claim 14 wherein the hydraulic means for powering includes a variable volume spring biased hydraulic fluid accumulator in close proximity to the area of the armature for continuously receiving high pressure fluid and intermittently supplying fluid to power the armature.

17. An asymmetrical bistable electronically controlled hydraulically powered transducer having an armature reciprocable between first and second positions, hydraulic means for powering the armature from the first position to the second position, a coil spring which is compressed during motion of the armature from the first position to the second position, compression of the coil spring slowing armature motion as it nears the second position, the hydraulic means maintaining pressure on the armature to temporarily preventing reversal of armature motion when the motion of the armature has slowed to a stop, the hydraulic means being disableable on command to allow the compressed coil spring to return the armature to the first position.

18. The asymmetrical bistable electronically controlled hydraulically powered transducer of claim 17 wherein the hydraulic means for powering includes a variable volume spring biased hydraulic fluid accumulator in close proximity to the area of the armature for continuously receiving high pressure fluid and intermittently supplying fluid to power the armature.

19. The asymmetrical bistable electronically controlled hydraulically powered transducer of claim 17 wherein the coil spring is under some compression at all times to assure firm positioning of the transducer in the first position.

20. The asymmetrical bistable electronically controlled hydraulically powered transducer of claim 17 further including a pair of variable volume chambers the volumes of which vary with armature reciprocation while the sum of the volumes of the two chambers remains substantially constant, the hydraulic means including means for selectively supplying high pressure fluid to one of said variable volume chambers, and a fluid sink for receiving low pressure fluid exhausted from the other of the variable volume chambers when high pressure fluid is being supplied to said one variable volume chamber.

* * * * *